US006079884A

United States Patent [19]

Yamashita

[11] Patent Number: 6,079,884

[45] Date of Patent: Jun. 27, 2000

[54] PHOTOGRAPHIC PROCESSING APPARATUS

[75] Inventor: Hiroshi Yamashita, Hino, Japan

[73] Assignee: Konica Corporation, Tokyo, Japan

[21] Appl. No.: 09/241,891

[22] Filed: Feb. 1, 1999

[30] Foreign Application Priority Data

Feb. 6, 1998 [JP] Japan ..... 10-025849

[51] Int. Cl.[7] ..... G03D 3/08

[52] U.S. Cl. ..... 396/612; 355/27

[58] Field of Search ..... 396/617, 620, 396/622, 612

[56] References Cited

U.S. PATENT DOCUMENTS 4,304,484 12/1981 Mizuta et al. .
4,967,222 10/1990 Nitsch .
4,975,723 12/1990 Hammerquist et al. .
5,177,522 1/1993 Hayashi ..... 354/320
5,669,035 9/1997 Kurematsu et al. ..... 396/626

FOREIGN PATENT DOCUMENTS

0784230 A1 7/1997 European Pat. Off. .

*Primary Examiner*—Safet Metjahic
*Assistant Examiner*—E P. LeRoux
*Attorney, Agent, or Firm*—Frishauf, Holtz, Goodman, Langer & Chick, P.C.

[57] ABSTRACT

An apparatus for processing a silver halide light sensitive photographic material is disclosed, comprising a first processing tank and a second processing tank adjacent to the first tank, wherein the value represented by RxL1/S is from 0.05 to 0.4, in which R represents a radius (cm) of curvature of an external turn section between the first processing tank and the second processing tank, L1 represents a path length (cm) in a portion immersed in a processing solution of the first processing tank and S represents a transport speed (cm/min.) of the photographic material at a processing station.

8 Claims, 1 Drawing Sheet

PHOTOGRAPHIC PROCESSING APPARATUS

FIELD OF THE INVENTION

The present invention relates to a processing apparatus used for photographic print paper (hereinafter, also simply referred to as a processing apparatus), and in particular to an apparatus for processing print paper, which has a relatively low frequency of problems such as transport troubles (such as so-called jamming), bending of the leading end and staining of the edge of the photographic web.

BACKGROUND OF THE INVENTION

Recently, there is an increasing desire for more rapid access of photographic processing, and on the other hand, an increase of mini-lab requests for a more compact automatic processing machine requiring a smaller floor area.

In view of the foregoing demands, JP-A Nos. 9-269575 and 9-269577 (herein, the term, JP-A means an unexamined and published Japanese Patent Application) disclose a technique of an automatic processing machine (hereinafter, also simply referred to as an automatic processor or a processing apparatus) for a silver halide light sensitive photographic material (hereinafter, also simply referred to as light sensitive material or photographic material), in which path length and transport speed in the processing section are particularly noted. In addition to the path length and transport speed of the processing section, JP-A No. 9-211823 discloses a technique in which, when a photographic material is immersed in a processing solution, attention is given to the curvature formed by the photographic material in the bottom section of a processing tank.

Application of the techniques described above reduces transport troubles (hereinafter, simply referred to as jams) and abrasion marks occurring in the interior of the processor while the photographic material is immersed in a processing solution. However, it was proven that the occurrence of passage troubles and abrasion markings of the photographic material is marked in the external turn section (a cross-over roller) to a subsequent processing tank rather than in the internal turn section immersing in the processing solution. In an automatic processor for print paper in which a photographic material coated on a paper support is subjected to processing, there further occurred other problems such as a bent leading edge of the photographic material or stains occurring in the vicinity of longitudinal edge portions of the photographic material (so-called edge stain).

The technique disclosed in JP-A No. 9-211823 concerns the curvature formed by the photographic material at the bottom of the processing tank, being definitely distinct from the present invention concerning the curvature formed in the external turn section which is not immersed in a processing solution.

In order to achieve a more rapid processing and a more compact automatic processor the radius of curvature (R) at the external turn section is typically reduced. However, excessive reduction of the radius of curvature tends to cause serious problems such that transport of the photographic material is not satisfactorily conducted or the emulsion side of the photographic material is brought into contact with upper or lower portions of the transport rack, resulting in abrasion marks on the photographic material surface.

A gelatin membrane of the photographic material is initially swollen only after the photographic material is immersed in a photographic solution. In a processing tank in which the photographic material is first subjected to processing, curliness is varied with the path length of the immersed portion of a processing section (L1) and the transport speed (S) so that frequency of transport troubles and abrasion marks occurring in the external turn section after coming out of the processing solution. Furthermore, when the transport speed is increased, jamming of the photographic material tends to occur near the transport guide roller, resulting in increased frequency of occurrence of transport troubles.

As a result of the inventors study of the foregoing, it was found that the frequency of transport troubles and abrasion markings occurring at the external turn section was markedly reduced by adjusting the value of RxL1/S to a specified range. It was further found that the bent leading edge of the photographic material and edge staining were also concurrently reduced. Such results were unexpected and surprising.

SUMMARY OF THE INVENTION

It is an object of the present invention to provide an apparatus for processing print paper which is relatively low in frequency of problems such as transport troubles (so-called jamming), bending of the leading end and staining of the edge of the photographic web.

The above object of the present invention can be accomplished by the following constitution:

1. an apparatus for processing a silver halide light sensitive photographic material comprising a first processing tank and a second processing tank adjacent to the first tank, wherein the value represented by RxL1/S is within the range of 0.05 to 0.4, wherein R represents a radius (cm) of curvature of an external turn section between the first processing tank and the second processing tank, L1 represents a path length (cm) in a portion immersed in a processing solution of the first processing tank and S represents a transport speed (cm/min.) of the photographic material at a processing station;
2. the processing apparatus described in 1, wherein the silver halide photographic material is a photographic paper;
3. the processing apparatus described in 1, wherein the first processing tank is a developing tank, the second processing tank being a bleach-fixing tank;
4. the processing apparatus described in 1, wherein the value of L2/L1 is within the range of 0.05 to 1.0, in which L2 represents a path length (cm) of the external turn section;
5. the processing apparatus described in 1, wherein the open top area ratio of at least one processing tank is within the range of 10 to 100 $cm^2/l$;
6. the processing apparatus described in 1, wherein 3 to 8 pairs of transport rollers are provided in the immersed portion of the first processing tank; and
7. the processing apparatus described in 1, wherein the photographic material is cut to a sheet form prior to processing.

DETAILED DESCRIPTION OF THE INVENTION

The processing apparatus according to the present invention comprises at least a first processing tank and an adjacent second processing tank in which a silver halide light sensitive photographic material is subjected to processing, and meets the requirement of the value of RxL1/S being within a range of 0.05 to 0.4 (cm.sec.), in which R represents the radius (cm) of curvature of an external turn section between the first processing tank and the adjacent second processing tank succeeding to the first tank, L1 represents the path length (cm) in a portion immersed in a processing solution of the first processing tank and S represents a transport speed (cm/min.) of the photographic material at a processing station. To display marked effects of the invention, the value of RxL1/S is preferably within the range of 0.1 to 0.3. A sectional view of the processing station of the processing apparatus for photographic print paper according to the invention is shown in FIG. 1.

Figure 1:
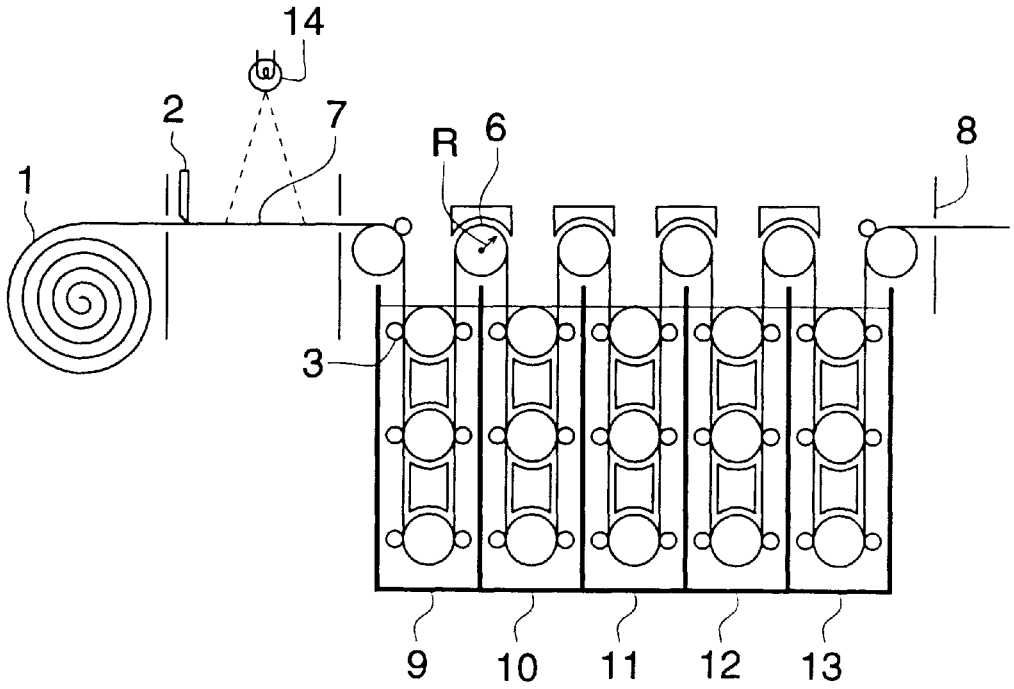
FIG. 1 illustrates a sectional view of a processing apparatus according to the present invention.

In the automatic processor as shown in FIG. 1, the processing station comprises rack 5 and tank 4. A processing solution is contained in the space formed by the rack and tank. Photographic material 1 is cut to a given size by a cutter (2), then exposed to light by means of an exposing apparatus (14) at the exposure station (7) and introduced into a color developing tank CD (9), in which the photographic material is transported by transport roller 3. When the photographic material is introduced from the left side to the rack, the photographic material is transported downward, moved by a reverse roller to the right side, further transported upward, and then introduced through an external turn section to the next tank, being bleach-fixing tank BF (10). Thereafter, the photographic material is similarly transported, further processed in successive first stabilizing tank STB-1 (11), second stabilizing tank STB-2 (12) and third stabilizing tank STB-3 (13), discharged through discharge door 8, and dried at the drying station.

The radius of curvature formed in the external turn section (6) of the processing apparatus as shown in FIG. 1 is 1.5 cm. However, the radius of curvature formed on the external turn section of the processing apparatus according to this invention is preferably within a range of 0.8 cm to 3.0 cm. In the course of transporting the photographic material from the first processing tank to the second processing tank, the photographic material is reversed through a roller or a guide. The radius of curvature in the external turn section refers to the radius of curvature of the roller or the guide (R), with which the photographic material is brought into contact. In cases where the photographic material is reversed through plural rollers or guldes in the external turn section, the smallest radius of curvature is defined as a radius of curvature according to the invention. In cases where the curvature of the guide varies in the course of the external turn section, the radius of curvature of the portion having the smallest radius of curvature is defined as the radius of curvature according to the invention.

In the invention, the path length of the portion immersed in a processing solution of the processing tank refers to the length from the point at which the photographic material is brought into contact with the processing solution of the processing tank, to the point at which the photographic material is carried out of the processing solution. In FIG. 1, the path length is 20 cm. The path length in the first processing tank according to the invention is preferably 5 cm to 100 cm, and more preferably 10 cm to 50 cm.

The ratio of the path length on the external turn section between the first processing tank in which the silver halide photographic material is processed in advance and the processing tank adjacent to the first tank (L2 cm) to the path length of the portion immersed in a processing solution of the first processing tank (L1 cm), L2/L1 was 0.3 in FIG. 1. According to the Present invention, the L2/L1 is preferably 0.05 to 1.0, and more preferably 0.1 to 0.5. The path length on the external turn section is the length between the point at which the photographic material is carried out of the processing solution and the point at which the photographic material is brought into contact with the processing solution of the succeeding processing tank.

In the processing apparatus shown in FIG. 1, the transport speed of a silver halide photographic material was 200 cm/min. In the processing apparatus according to the invention, however, the transport speed of the photographic material is preferably 50 cm/min. to 500 cm/min., and more preferably 100 cm/min. to 300 cm/min. in terms of reduction of jamming.

The processing tank volume of the processing apparatus according to this invention is preferably 0.5 to 10 liters, and more preferably 2 to 5 liters. In the processing apparatus shown in FIG. 1, each of processing tanks was 5.0 liters. In cases where a processing tank is provided with a sub-tank, the volume of the sub-tank is also included in the tank volume according to this invention.

In the processing apparatus according to the invention, the open top area ratio of at least one processing tank (preferably that of the first processing tank) is preferably 10 to 100 $m^2/l$, and more preferably 20 to 50 $m^2/l$ in terms of storage stability. In the processing apparatus shown in FIG. 2, the open top area ratio was 30 m2/l. Herein, the open top area ratio is defined as the open surface area (which is in contact with air) of the processing solution contained in a tank, expressed in T ($cm^2$), divided by the volume of the processing solution, expressed in V (l). Thus, the open top area is defined as T/V ($cm^2/l$).

It is preferable that in the processing apparatus according to this invention, 3 to 8 pairs of transport rollers are provided in the immersion portion of the processing tank. In FIG. 1, 6 pairs of transport rollers were provided.

The circulating rate of the processing solution contained in the tank of the processing apparatus according to the invention is preferably 0.1 to 20 l/min., and more preferably 1 to 10 l/min. in terms of minutely controlling the temperature of the processing solution. In the processing apparatus shown in FIG. 1, the circulation rate of the color developing tank was 5.0 l/min. and that of the other processing tanks was 3.0 l/min. Cited as a pump employed are magnet pumps MD-10, MD-20 and MD-30. The processing solution may be injected under high pressure onto the emulsion side of the photographic material (jet stirring).

Any one of the processing solutions composed according to conventional formula can be employed. Examples thereof include a color developing solution, a processing solution having bleaching capability, a processing solution having fixing capability and a stabilizing solution, as described in JP-A No. 7-281376.

Photographic materials processed in the present invention are those comprising silver chloride, silver chlorobromide, silver bromide or silver iodobromide. Of these preferred is a photographic material comprising a high chloride-containing silver chlorobromide emulsion.

The photographic material may comprise a silver halide emulsion layer having a multi-layer structure. The emulsion layer may be coated on one side or both sides of the support. The photographic material may comprise a magnetic recording layer containing magnetic substance.

In one of the preferred embodiments of the present invention, the photographic material, which has been cut into sheet form, is transported. The expression "has been cut into sheet form" includes the case of cutting the photographic paper in roll immediately before exposure or immediately before being immersed in the first processing solution.

Figure 2:
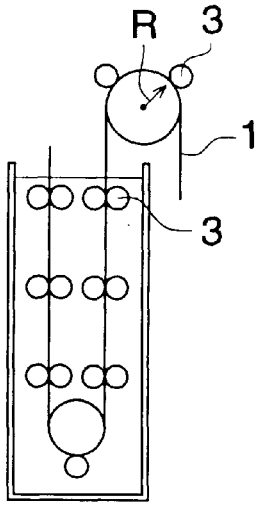
FIG. 2 illustrates a sectional view of the processing station of a processing apparatus accordign to the present invention.

FIG. 2 illustrates another example of the processing station of the processing apparatus according to this invention, in which 7 pairs of transport rollers are provided in the immersion portion of the processing solution.

EXAMPLES

The present invention will be explained based on examples, but embodiments of the present invention are not limited to these examples.

Example 1

500 sheets of Konica color QA paper type A6 of L-sheet size were continuously processed with a color developing solution, bleach-fixing solution and a stabilizing solution of CPK-2-28 process used for Konica color QA paper according to the process described below, using an automatic processor similar to the one illustrated in FIG. 1, in which the radius of curvature of an external turn section between a color developing tank and a bleach-fixing tank (R cm), the path length of the portion immersed in a color developing solution of the color developing tank (L1 cm) and the transport speed of a photographic material (S cm/min), as shown in Table 1. In the course of processing, the processed photographic material was evaluated with respect to the frequency of passage troubles (jamming) of the photographic material which occurred in the external turn section between the color developing tank and the bleach-fixing tank, abrasion marks, frequency of bending of the leading end of the photographic material and edge staining. Results thereof are summarized in Table 1. Processing

| Proc. step | Proc. temp. (° C.) | Replenishinq rate (ml/m$^2$) |
|---|---|---|
| Color developing | 42 | 65 |
| Bleach-fixing | 39 | 65 |
| Stabilizing-1 | 39 | |
| Stabilizing-2 | 39 | |
| Stabilizing-3 | 39 | 120 |

The stabilizing process was three-steps counter-current system from step 3 to step 1.

Evaluation of Jamming

Of 500 sheets of processed photographic materials, the frequency of passage troubles which occurred between the color developing tank and the bleach-fixing tank was measured. Evaluation of abrasion marks was based on the following criteria:

A: No abrasion mark was observed in any of the photographic materials processed.

B: Slight abrasion marks were observed in some of the photographic materials.

C: Evident abrasion marks were observed in some of the photographic materials.

D: Evident abrasion marks were observed in almost all of the photographic materials.

Evaluation of Bent Leading Edges:

Of 500 sheets of processed photographic materials, the frequency of bending of the leading end was measured.

Evaluation of Edge Staining was Based on the Following Criteria:

A: No stain in edge portions of processed photographic materials was observed.

B: The edge portions appeared to be slightly yellowish when making overlapping processed photographic materials and observing from the edge.

C: The edge portions appeared to be yellowish when making overlapping processed photographic materials and observing from the edge side.

D: Peripheral portions of the processed photographic material appeared to be yellowish even when viewed from the front.

TABLE 1

| Expt. No. | R (cm) | L1 (cm) | S (cm/min) | RxL1/S | Jamming | Abrasion mark | Bending of leading edge | Edge stain | Remark |
|---|---|---|---|---|---|---|---|---|---|
| 1-1 | 0.4 | 20 | 200 | 0.04 | 17 | D | 19 | C | Comp. |
| 1-2 | 0.5 | 20 | 200 | 0.05 | 4 | C | 7 | B | Inv. |
| 1-3 | 0.8 | 20 | 200 | 0.08 | 3 | B | 5 | B | Inv. |
| 1-4 | 1.0 | 20 | 200 | 0.10 | 1 | A | 2 | A | Inv. |
| 1-5 | 1.5 | 20 | 200 | 0.15 | 0 | A | 0 | A | Inv. |
| 1-6 | 2.0 | 20 | 200 | 0.20 | 0 | A | 0 | A | Inv. |
| 1-7 | 3.0 | 20 | 200 | 0.30 | 0 | A | 0 | A | Inv. |
| 1-8 | 4.0 | 20 | 200 | 0.40 | 0 | B | 0 | B | Inv. |
| 1-9 | 5.0 | 20 | 200 | 0.50 | 0 | D | 1 | D | Comp. |
| 1-10 | 6.0 | 20 | 200 | 0.60 | 0 | D | 1 | D | Comp. |
| 1-11 | 1.2 | 7 | 200 | 0.042 | 22 | D | 16 | C | Comp. |
| 1-12 | 1.2 | 9 | 200 | 0.054 | 4 | B | 6 | B | Inv. |
| 1-13 | 1.2 | 12 | 200 | 0.072 | 4 | B | 5 | B | Inv. |
| 1-14 | 1.2 | 15 | 200 | 0.09 | 3 | B | 4 | B | Inv. |
| 1-15 | 1.2 | 20 | 200 | 0.12 | 1 | A | 1 | A | Inv. |
| 1-16 | 1.2 | 30 | 200 | 0.18 | 0 | A | 0 | A | Inv. |

TABLE 1-continued

| Expt. No. | R (cm) | L1 (cm) | S (cm/min) | RxL1/S | Jamming | Abrasion mark | Bending of leading edge | Edge stain | Remark |
|---|---|---|---|---|---|---|---|---|---|
| 1-17 | 1.2 | 40 | 200 | 0.24 | 0 | A | 0 | A | Inv. |
| 1-18 | 1.2 | 50 | 200 | 0.30 | 0 | A | 0 | A | Inv. |
| 1-19 | 1.2 | 60 | 200 | 0.36 | 0 | B | 0 | B | Inv. |
| 1-20 | 1.2 | 70 | 200 | 0.42 | 2 | D | 3 | D | Comp. |
| 1-21 | 1.2 | 20 | 800 | 0.03 | 31 | D | 38 | C | Comp. |
| 1-22 | 1.2 | 20 | 600 | 0.04 | 23 | D | 27 | C | Comp. |
| 1-23 | 1.2 | 20 | 480 | 0.05 | 5 | B | 6 | B | Inv. |
| 1-24 | 1.2 | 20 | 360 | 0.067 | 4 | B | 6 | B | Inv. |
| 1-25 | 1.2 | 20 | 240 | 0.10 | 1 | A | 2 | A | Inv. |
| 1-26 | 1.2 | 20 | 200 | 0.12 | 1 | A | 1 | A | Inv. |
| 1-27 | 1.2 | 20 | 120 | 0.20 | 0 | A | 0 | A | Inv. |
| 1-28 | 1.2 | 20 | 80 | 0.30 | 0 | A | 0 | A | Inv. |
| 1-29 | 1.2 | 20 | 60 | 0.40 | 0 | B | 0 | B | Inv. |
| 1-30 | 1.2 | 20 | 50 | 0.48 | 1 | D | 1 | D | Comp. |
| 1-31 | 1.2 | 20 | 40 | 0.60 | 1 | D | 2 | D | Comp. |

As can be seen from Table 1, when the radius of curvature of an external turn section between the first tank and the successive second tank was R cm, the path length of the portion immersed in a color developing solution of the color developing tank was L1 cm and the transport speed of a photographic material was S cm/min, it was proved that the value of RxL1/S of 0.05 to 0.4 led to satisfactory results with respect to the passage troubles and occurrence of abrasion marks, bent leading edges and edge stains of the photographic material.

Example 2

The path length (L2 cm) of the external turn section between the color developing tank and the bleach-fixing tank of an automatic processor similar to the one as illustrated in FIG. 1 was varied as shown in Table 2, provided that the radius of curvature of an external turn section between the first tank and the successive second tank was 1.5 cm, the path length (L1 cm) of the portion immersed in a color developing solution of the color developing tank was 30 cm and the transport speed of a photographic material was 180 cm/min. The photographic material was subjected to continues processing and evaluated in a manner similar to Example 1. Results thereof are shown in Table 2.

TABLE 2

| Expt. No. | L2 (cm) | L2/L1 | Jamming | Abrasion mark | Bending of leading edge | Edge stain |
|---|---|---|---|---|---|---|
| 2-1 | 0.9 | 0.03 | 4 | B | 5 | B |
| 2-2 | 1.2 | 0.04 | 3 | B | 5 | B |
| 2-3 | 1.5 | 0.05 | 1 | A | 2 | A |
| 2-4 | 2.1 | 0.07 | 1 | A | 2 | A |
| 2-5 | 3 | 0.10 | 0 | A | 0 | A |
| 2-6 | 6 | 0.20 | 0 | A | 0 | A |
| 2-7 | 9 | 0.30 | 0 | A | 0 | A |
| 2-8 | 15 | 0.50 | 0 | A | 0 | A |
| 2-9 | 24 | 0.80 | 1 | A | 1 | A |
| 2-10 | 30 | 1.0 | 1 | A | 2 | A |
| 2-11 | 36 | 1.2 | 4 | B | 5 | B |
| 2-12 | 45 | 1.5 | 4 | B | 6 | B |

As can be seen from Table 2, when the ratio of the path length (L2 cm) of the external turn section to the path length (L1 cm) of the portion immersed in the developing solution, i.e., L2/L1 was within the range of 0.05 to 0.10, it was proved that advantageous effects of the present were achieved.

Example 3

The photographic material was subjected to continuous processing and evaluated in a manner similar to Example 1 using an automatic processor similar to the one as illustrated in FIG. 1, provided that the open top area ratio was varied by inserting a member into the liquid surface, as shown in Table 3 and the R, L1, L2 and S were 15 cm, 20 cm, 6 cm and 200 cm.min., respectively. Results thereof are shown in Table 3.

TABLE 3

| Expt. No. | Open top area ratio ($cm^2/1$) | Abrasion mark | Bending of leading edge | Edge stain |
|---|---|---|---|---|
| 3-1 | 5 | B | 3 | B |
| 3-2 | 8 | B | 3 | B |
| 3-3 | 10 | A | 1 | A |
| 3-4 | 15 | A | 1 | A |
| 3-5 | 20 | A | 0 | A |
| 3-6 | 30 | A | 0 | A |
| 3-7 | 40 | A | 0 | A |
| 3-8 | 50 | A | 0 | A |
| 3-9 | 70 | A | 1 | A |
| 3-10 | 100 | A | 1 | A |
| 3-11 | 120 | B | 3 | B |
| 3-12 | 150 | B | 4 | B |

As can be seen from Table 3, it was proved that when the open top area ratio of the processing tank was within the range of 10 to 100 $cm^2/l$, advantageous effects of the present invention were achieved, and specifically when it was 20 to 50 $cm^2/1$, the effects were markedly improved.

Example 4

The photographic material was subjected to continuous processing and evaluated in a manner similar to Example 1 using an automatic processor similar to one as shown in FIG. 1, provided that the number of transport rollers immersed in the developing solution was varied, as shown in Table 4 and the R, L1, L2 and S were 15 cm, 20 cm, 6 cm and 200 cm.min., respectively. Results thereof are shown in Table 4.

TABLE 4

| Expt. No. | No. of roller (pair) | Jamming | Abrasion mark | Bending of leading edge | Edge stain |
|---|---|---|---|---|---|
| 4-1 | 1 | 5 | A | 7 | B |
| 4-2 | 2 | 4 | A | 6 | B |
| 4-3 | 3 | 1 | A | 1 | A |
| 4-4 | 4 | 1 | A | 1 | A |
| 4-5 | 5 | 0 | A | 0 | A |
| 4-6 | 6 | 0 | A | 0 | A |
| 4-7 | 7 | 0 | A | 0 | A |
| 4-8 | 8 | 0 | A | 1 | A |
| 4-9 | 9 | 3 | B | 5 | B |
| 4-10 | 10 | 4 | B | 6 | B |

As can be seen from Table 4, it was proved that 3 to 8 pairs of transport rollers immersed in the color developing solution of the first tank were preferred.

Example 5

Continuous processing was conducted, using an automatic processor similar to the one as shown in FIG. 1, provided that the radius of curvature of an external turn section between the first tank and the successive second tank (R cm), the path length of the portion immersed in a color developing solution of the color developing tank (L1 cm) and the transport speed of a photographic material (S cm/min) were adjusted so that RxL1/S meets the value as shown in Table 5. 300 pieces of the photographic material (color paper) in a roll form (89 mm in width×800 mm in length) or in a sheet form (89 mm in width×127 mm in length) were continuously processed and evaluated in a manner similar to Example 1. Results thereof are shown in Table 5.

TABLE 5

| Expt. No. | Phot. material | RxL1/S | Jamming | Bending of leading edge | Edge stain | Remark |
|---|---|---|---|---|---|---|
| 5-1 | Roll | 0.04 | 8 | 12 | B | Comp. |
| 5-2 | Roll | 0.15 | 0 | 0 | A | Inv. |
| 5-3 | Roll | 0.50 | 0 | 1 | C | Comp. |
| 5-4 | Sheet | 0.04 | 11 | 19 | C | Comp. |
| 5-5 | Sheet | 0.15 | 0 | 0 | A | Inv. |
| 5-6 | Sheet | 0.50 | 0 | 1 | D | Comp. |

As can be seen from Table 5, transport problems are marked when comparative samples in sheet form were transported, and improved results were marked in using the automatic processor according to the invention.

What is claim is:

1. An apparatus for processing a silver halide light sensitive photographic material comprising:

a first processing tank; and a second processing tank adjacent to the first tank, wherein the value represented by RxL1/S is at least 0.05 and at most 0.4, wherein R is a radius (cm) of curvature of an external turn section between the first processing tank and the second processing tank, L1 is a path length (cm) in a portion immersed in a processing solution of the first processing tank, and S is a transport speed (cm/min.) of the photographic material at a processing station.

2. The processing apparatus of claim 1, wherein said silver halide light sensitive photographic material is a photographic paper.

3. The processing apparatus of claim 1, wherein said first processing tank is a developing tank, the second processing tank being a bleach-fixing tank.

4. The processing apparatus of claim 1, wherein L2/L1 is within the range of 0.5 to 1.0, and L2 is a path length (cm) of the external turn section between the first and second tanks.

5. The processing apparatus of claim 1, wherein an open top area ratio of at least one processing tank is within the range of 10 to 100 $cm^2/l$.

6. The processing apparatus of claim 1, wherein at least 3 and at most 8 pairs of transport rollers are provided in the immersed portion of the first processing tank.

7. The processing apparatus of claim 1, wherein the photographic material is cut to a sheet form prior to being subjected to processing.

8. The processing apparatus of claim 1, wherein R is at least 0.8 and at most 3.0 cm, L1 is at least 5.0 and at most 100 cm, and S is at least 50 and at most 500 cm/min.

* * * * *